US007845645B1

(12) United States Patent
Chu et al.

(10) Patent No.: US 7,845,645 B1
(45) Date of Patent: Dec. 7, 2010

(54) WEIGHT-CONTROLLED COIN-BEARING BOARD DEVICE FOR COIN-THROWING GAME MACHINE

(75) Inventors: Yi-Ting Chu, Shu-Lin (TW); Chu-Yi Chang, Banciao (TW)

(73) Assignee: Saint-Fun International Ltd., Shu-Lin, Taipei Hsien (TW)

( * ) Notice: Subject to any disclaimer, the term of this patent is extended or adjusted under 35 U.S.C. 154(b) by 0 days.

(21) Appl. No.: 12/582,704

(22) Filed: Oct. 20, 2009

(51) Int. Cl.
*A63F 9/02* (2006.01)

(52) U.S. Cl. ..... 273/348

(58) Field of Classification Search ..... 273/348, 273/371, 374, 375, 317, 440, 459, 449, 450, 273/460

See application file for complete search history.

(56) References Cited

U.S. PATENT DOCUMENTS 4,496,160 A * 1/1985 Wichinsky et al. ..... 273/369
5,501,466 A * 3/1996 Welch et al. ..... 273/355
5,511,794 A * 4/1996 Katamoto ..... 273/440
6,109,613 A * 8/2000 Crompton et al. ..... 273/354
6,520,500 B2 * 2/2003 Pierce et al. ..... 273/108
7,703,772 B2 * 4/2010 Morikawa et al. ..... 273/440
7,780,171 B2 * 8/2010 Mukasa et al. ..... 273/440
2006/0027973 A1 * 2/2006 Nireki et al. ..... 273/440

* cited by examiner

*Primary Examiner*—Raleigh W. Chiu
(74) *Attorney, Agent, or Firm*—PAI Patent & Trademark Law Firm; Chao-Chang David Pai

(57) ABSTRACT

A weight-controlled coin-bearing board device used in a game machine includes a bearing board pivotally supported on a mounting plate inside the game machine for collecting coins/tokens, a counterweight for keeping the bearing board in balance, screw bolts fastened to the rear side of the bearing board to secure the counterweight, and nuts selectively mountable on the screw bolts to adjust the weight of the counterweight. When the total torque caused by the weight of collected coins/tokens surpasses a preset value, the bearing board is forced to tilt, causing collected coins/tokens to fall from the bearing board.

9 Claims, 8 Drawing Sheets

WEIGHT-CONTROLLED COIN-BEARING BOARD DEVICE FOR COIN-THROWING GAME MACHINE

BACKGROUND OF THE INVENTION (a) Field of the Invention

The present invention relates to game machines and, more particularly, to a weight-controlled coin-bearing board device for coin-throwing game machine, which collects thrown coins and enables accumulated coins to fall when the total torque caused by the weight of accumulated coins surpasses a predetermined value, and which allows adjustment of such predetermined value.

(b) Description of the Prior Art

A coin/token throwing game machine is known to be using a coin-pushing mechanism to push thrown coins/tokens on a platform, causing collected coins/tokens to be squeezed against one another and stacked up. When coins/tokens are pushed to an exit, they fall to a slot as a prize. This game provides little challenge to the players.

SUMMARY OF THE INVENTION

The present invention has been accomplished under the circumstances in view. It is one object of the present invention to provide a weight-controlled coin-bearing board device for use in a game machine, which utilizes the seesaw motion to control falling of collected coins/tokens, thereby allowing the player to get a score or prize in the game.

To achieve this and other objects of the present invention, a weight-controlled coin-bearing board device comprises a bearing board pivotally supported on a mounting plate inside the game machine for collecting coins/tokens, a counterweight for keeping the bearing board in balance, screw bolts fastened to the rear side of the bearing board to secure the counterweight, and nuts selectively mountable on the screw bolts to adjust the weight of the counterweight. When the total torque (about the pivotal point on the mounting plate) caused by the weight of collected coins/tokens surpasses a preset value, the bearing board is forced to tilt, causing the collected coins/tokens to fall from the bearing board.

DETAILED DESCRIPTION OF THE PREFERRED EMBODIMENTS

Figure 1:
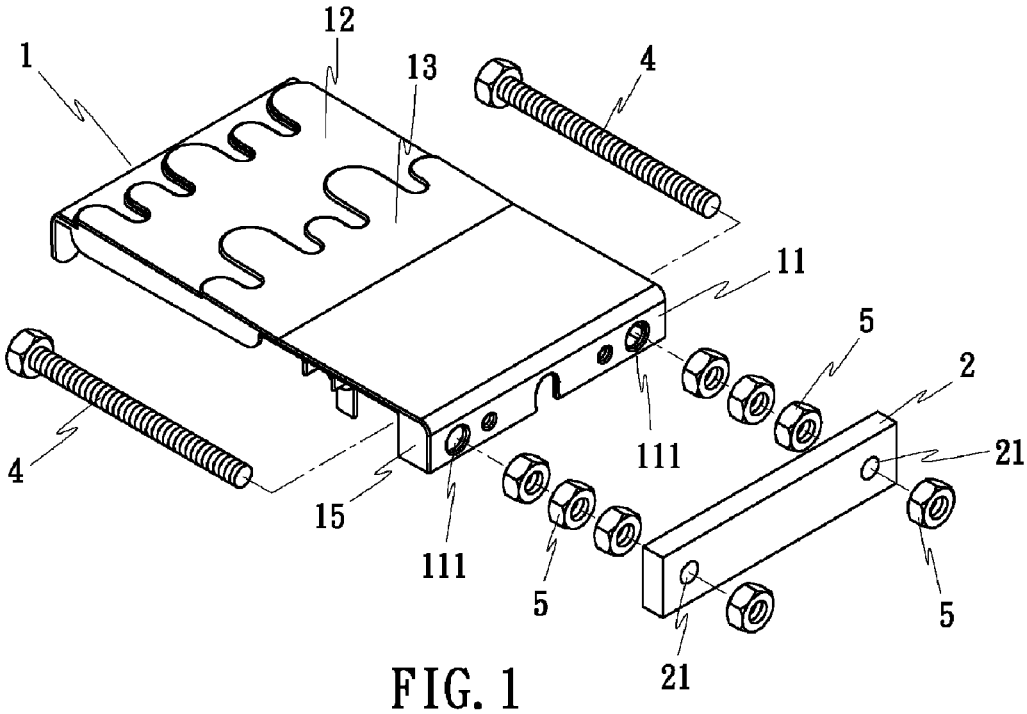
FIG. 1 is an exploded view of a weight-controlled coin-bearing board device for coin-throwing game machine according to the present invention.
Figure 2:
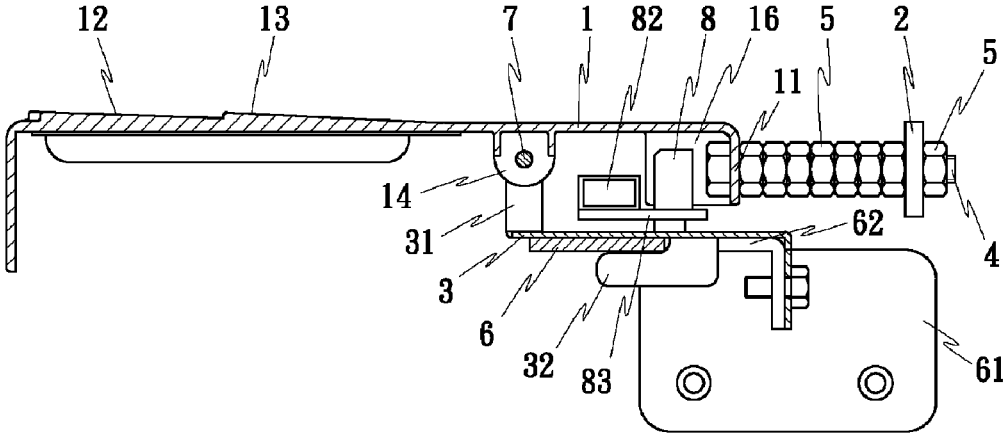
FIG. 2 is a sectional side view of the weight-controlled coin-bearing board device for coin-throwing game machine according to the present invention, showing a relatively large number of nuts.
Figure 3:
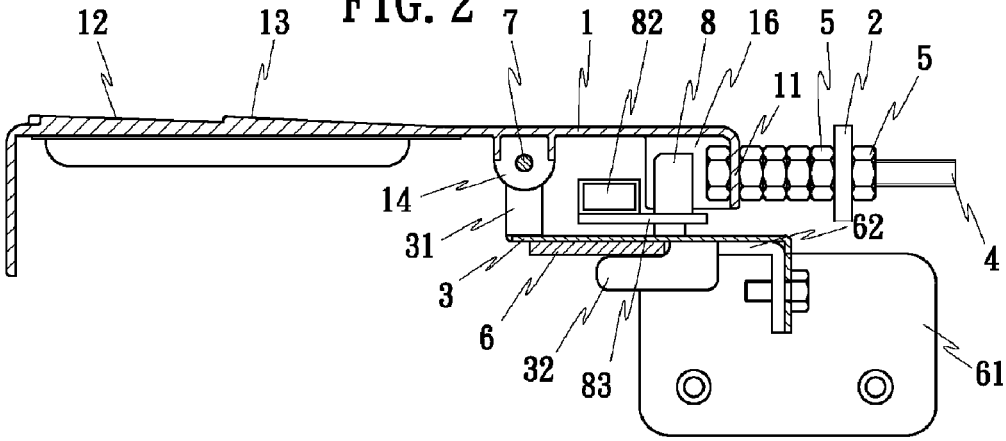
FIG. 3 is a sectional side view of the weight-controlled coin-bearing board device for coin-throwing game machine according to the present invention, showing a relatively small number of nuts.

As shown in FIGS. 1~3, a weight-controlled coin-bearing board device for coin-throwing game machine in accordance with the present invention comprises a bearing board 1 and a counterweight 2.

Figure 4:
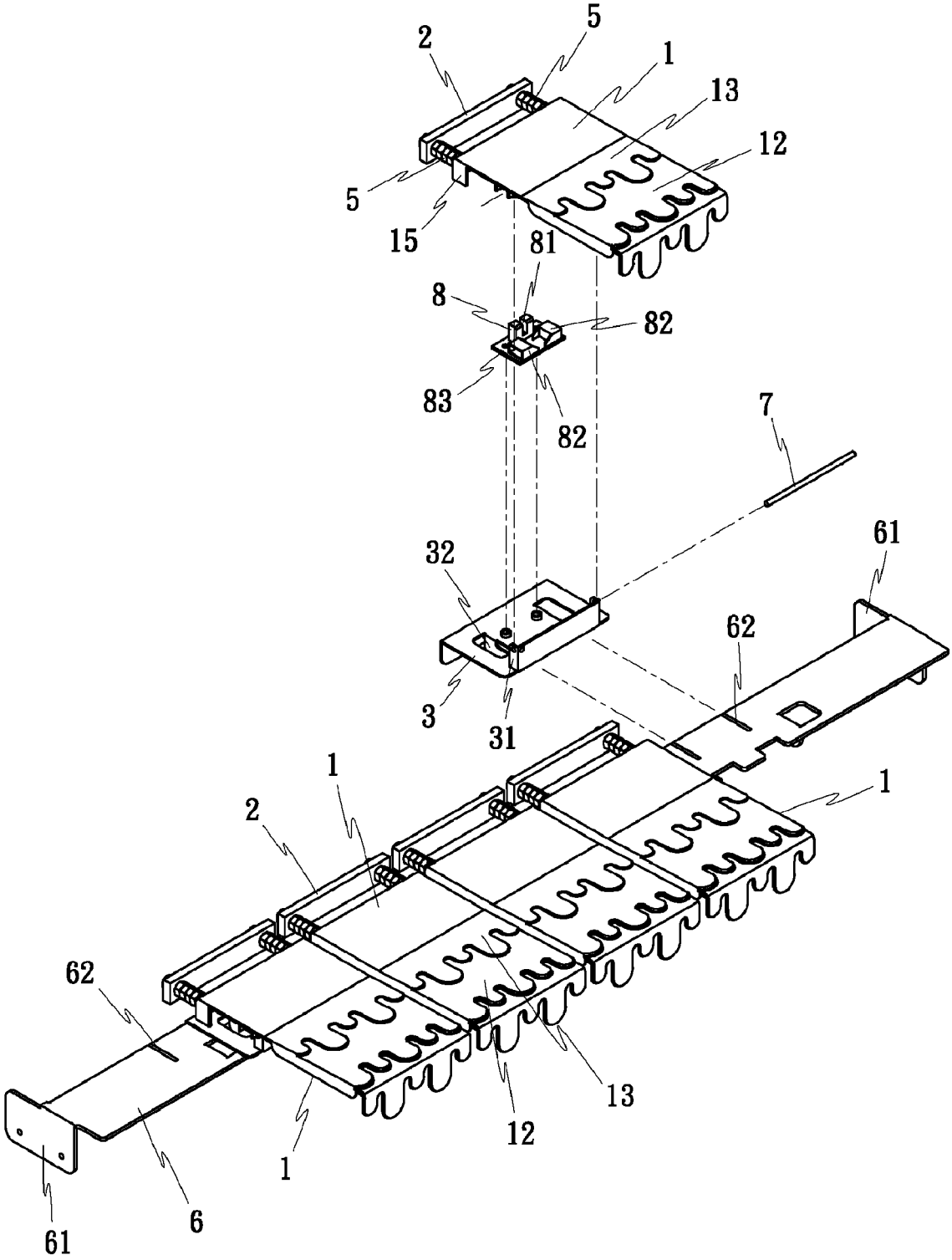
FIG. 4 is an exploded view of the present invention, showing mounting arrangement of the weight-controlled coin-bearing board device with an associated photo sensor and an associated mounting plate on a support plate.

The bearing board 1 is pivotally connected to an upright flange 31 of a mounting plate 3 (see FIG. 4). Further, the bearing board 1 is a flat board having a rear flange 11 downwardly extending from the rear side thereof, at least one, for example, two mounting through holes 111 located on the rear flange 11, at least one, for example, two sloping top surface portions 12 and 13 disposed near the front side and rising one behind the other, and at least one, for example, two bottom lugs 14 pivotally connected to the upright flange 31. The two sloping top surface portions 12 and 13 slope downwardly in a direction from the front side toward the rear side to facilitate accumulation of coins. Further, each sloping top surface portion 12 or 13 has its front edge configured to show a wave-like contour.

The counterweight 2 has at least one, for example, two mounting through holes 21 respectively fastened to the mounting through holes 111 on the rear flange 11 of the bearing board 1 with screw bolts 4 and nuts 5. The screw bolts 4 and nuts 5 are prepared from metal or any of a variety of other heavy materials. By means of adjusting the number of nuts 5, the total weight at the side around the counterweight 2 is relatively adjusted. For example, the number of nuts 5 in FIG. 2 is increased so that the total weight at the side around the counterweight 2 is increased. Comparatively, the number of nuts 5 in FIG. 3 is reduced so that the total weight at the side around the counterweight 2 is reduced.

Figure 6:
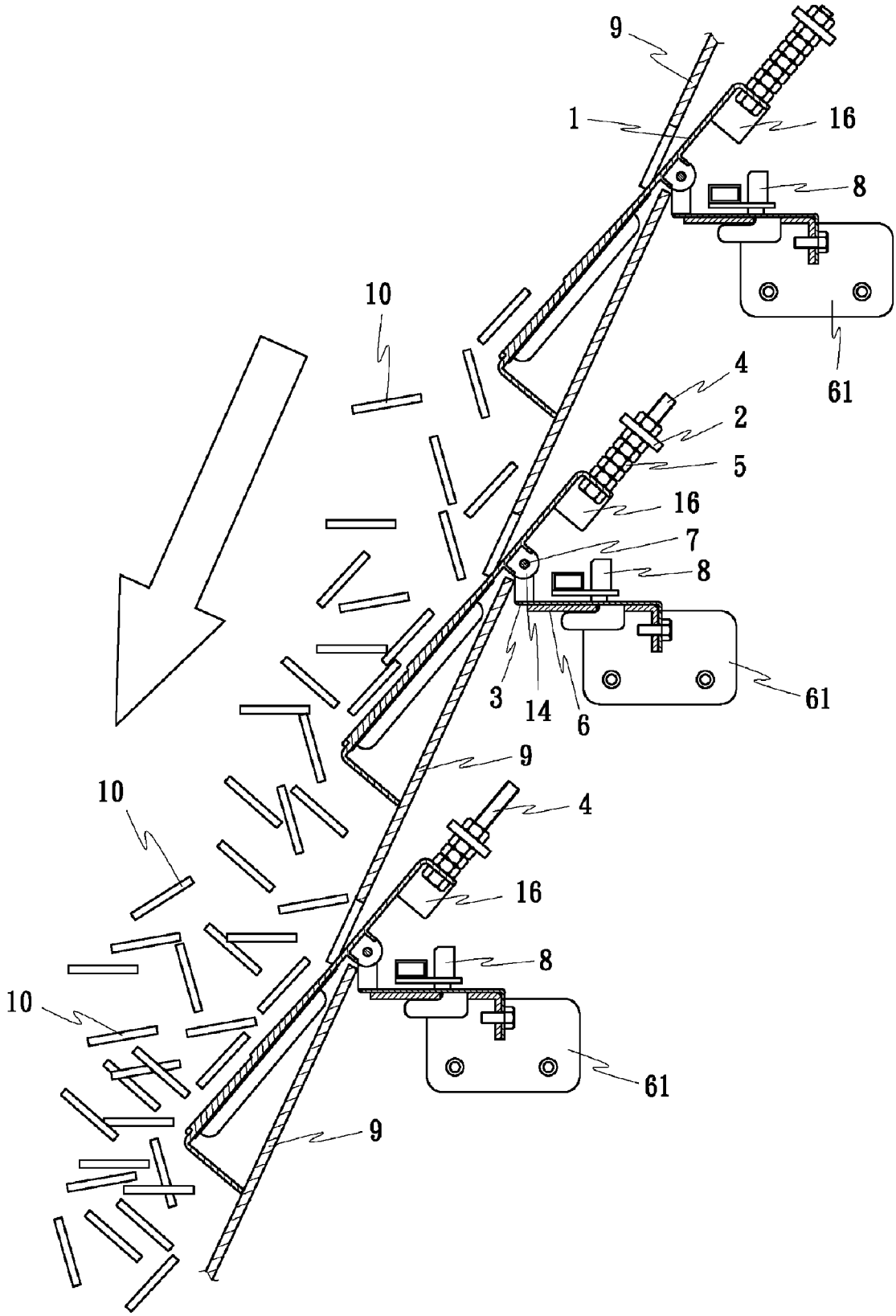
FIG. 6 corresponds to FIG. 5, showing the bearing boards tilted, coins falling from the tilted bearing boards.
Figure 7:
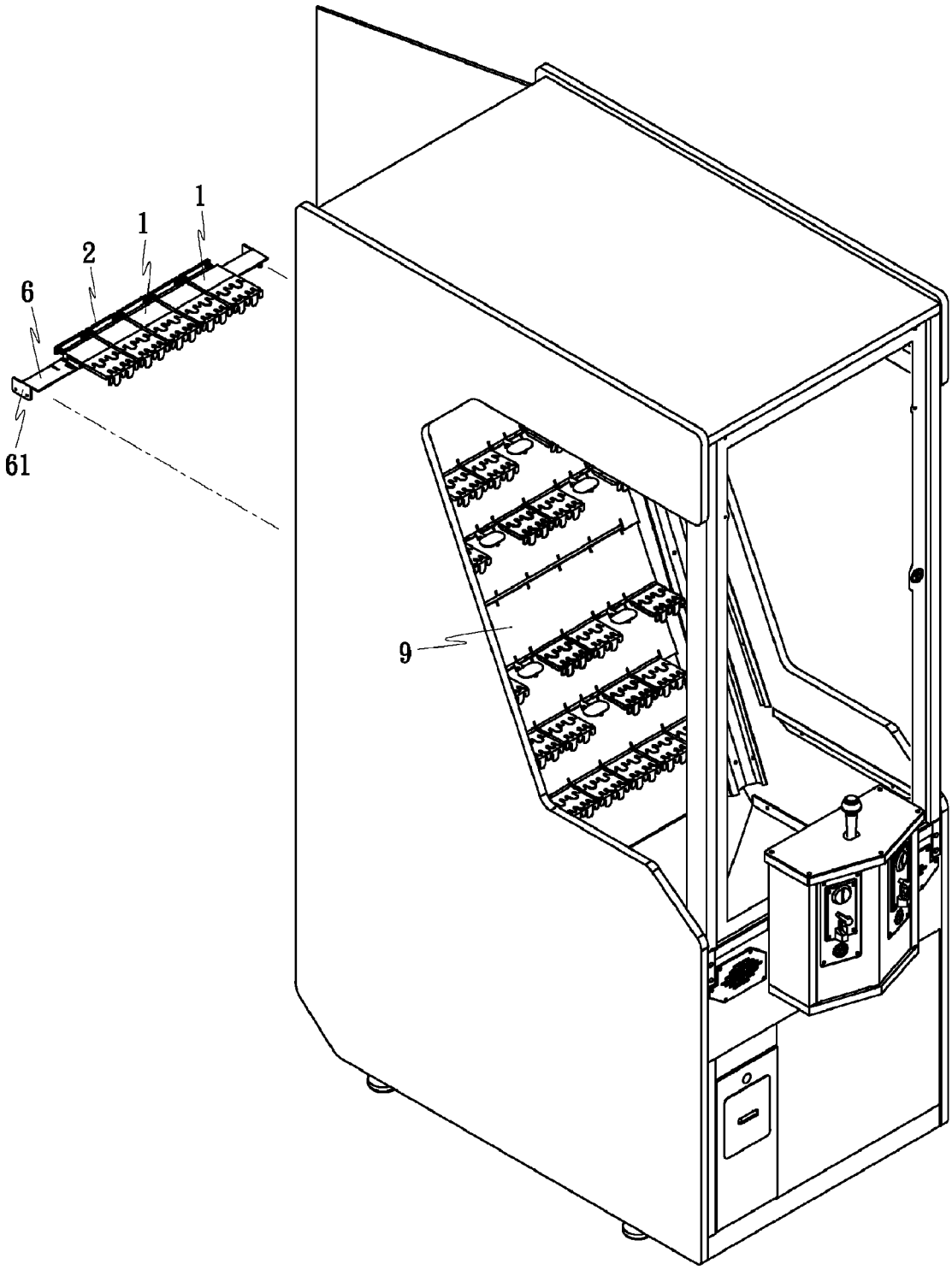
FIG. 7 is a schematic drawing showing an application of the present invention in a coin-throwing game machine.
Figure 8:
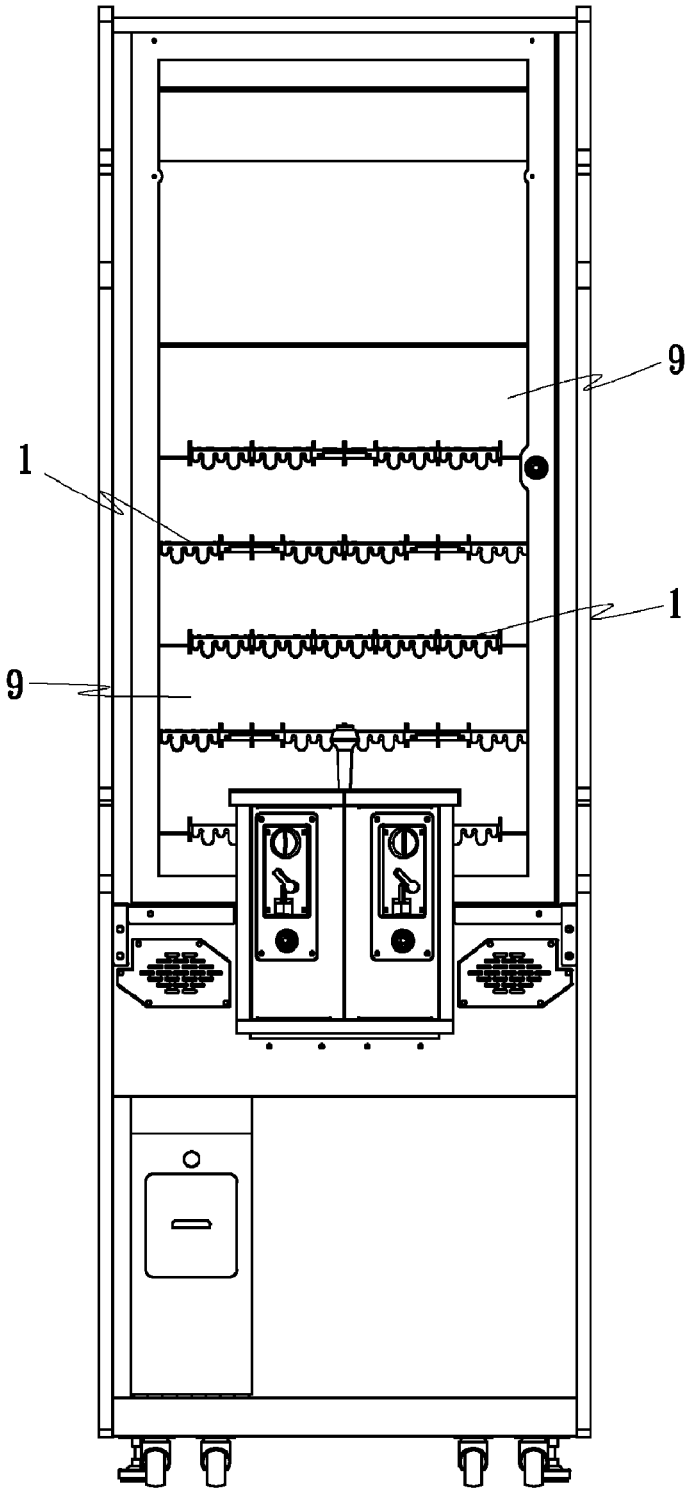
FIG. 8 is a front view of the coin-throwing game machine according to the present invention.
Figure 9:
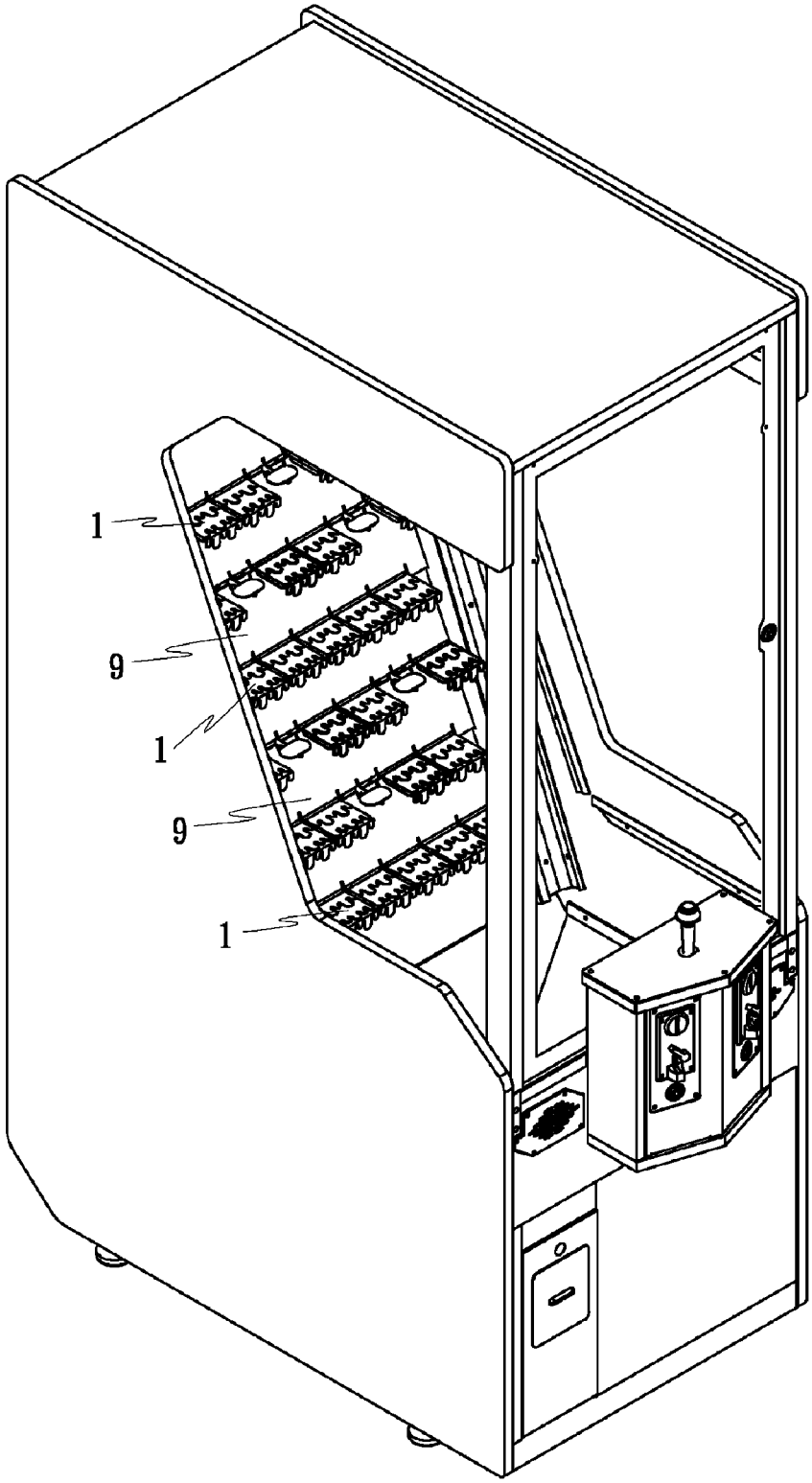
FIG. 9 is an oblique elevation view of the coin-throwing game machine according to the present invention.
Figure 10:
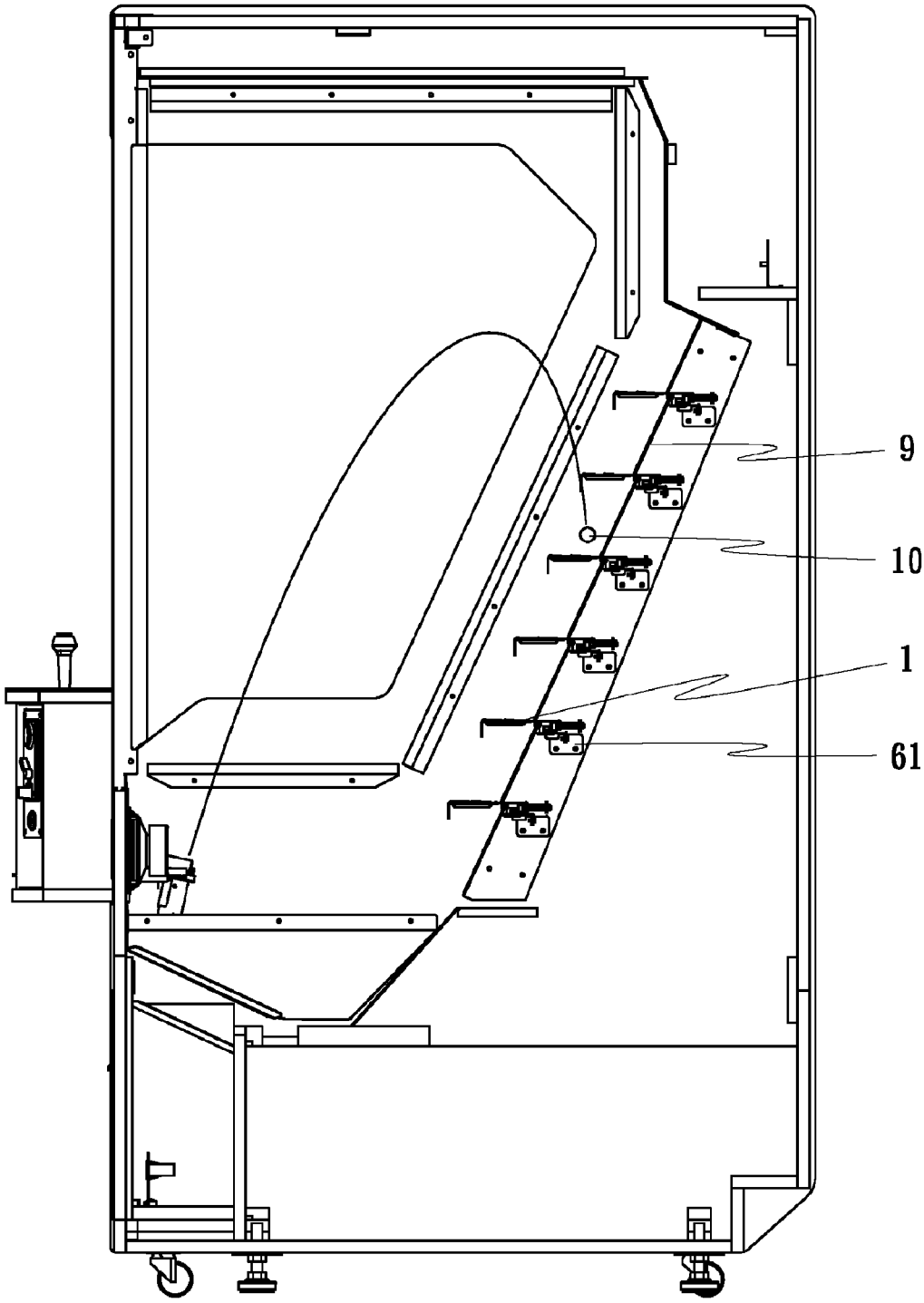
FIG. 10 is a schematic side view, showing an operation status of the coin-throwing game machine according to the present invention.

As stated above, the bearing board 1 is pivotally supported on the upright flange 31 of a mounting plate 3, and the counterweight 2 works with the screw bolts 4 and the loaded nuts 5 to keep the bearing board 1 in balance. By means of changing the number of nuts 5, the total weight at the side around the counterweight 2 is relatively changed. When the total torque (about the pivotal point on the upright flange 31) caused by the total weight of the coins accumulated on the sloping top surface portions 12 and 13 surpasses the total torque caused by the weight at the side around the counterweight 2, the bearing board 1 tilts like the action of a seesaw, causing the accumulated coins to fall from the bearing board 1 (see FIG. 6).

Referring to FIG. 4, multiple weight-controlled coin-bearing board devices are arranged in parallel on a support plate 6, i.e., multiple bearing boards 1 and counterweights 2 are arranged in a row on one support plate 6. The support plate 6 is a narrow elongated plate member, having two end flanges 61 for fastening to two opposite inside walls of the game machine housing. After installation of the support plate 6 in the game machine housing, multiple mounting plates 3 are fastened to the support plate 6, and then bearing boards 1 are respectively pivotally connected to the mounting plates 3, and then counterweights 2 are respectively fastened to the bearing boards 1. Thus, multiple weight-controlled coin-bearing board devices are arranged on a support plate 6 in a row.

Figure 5:
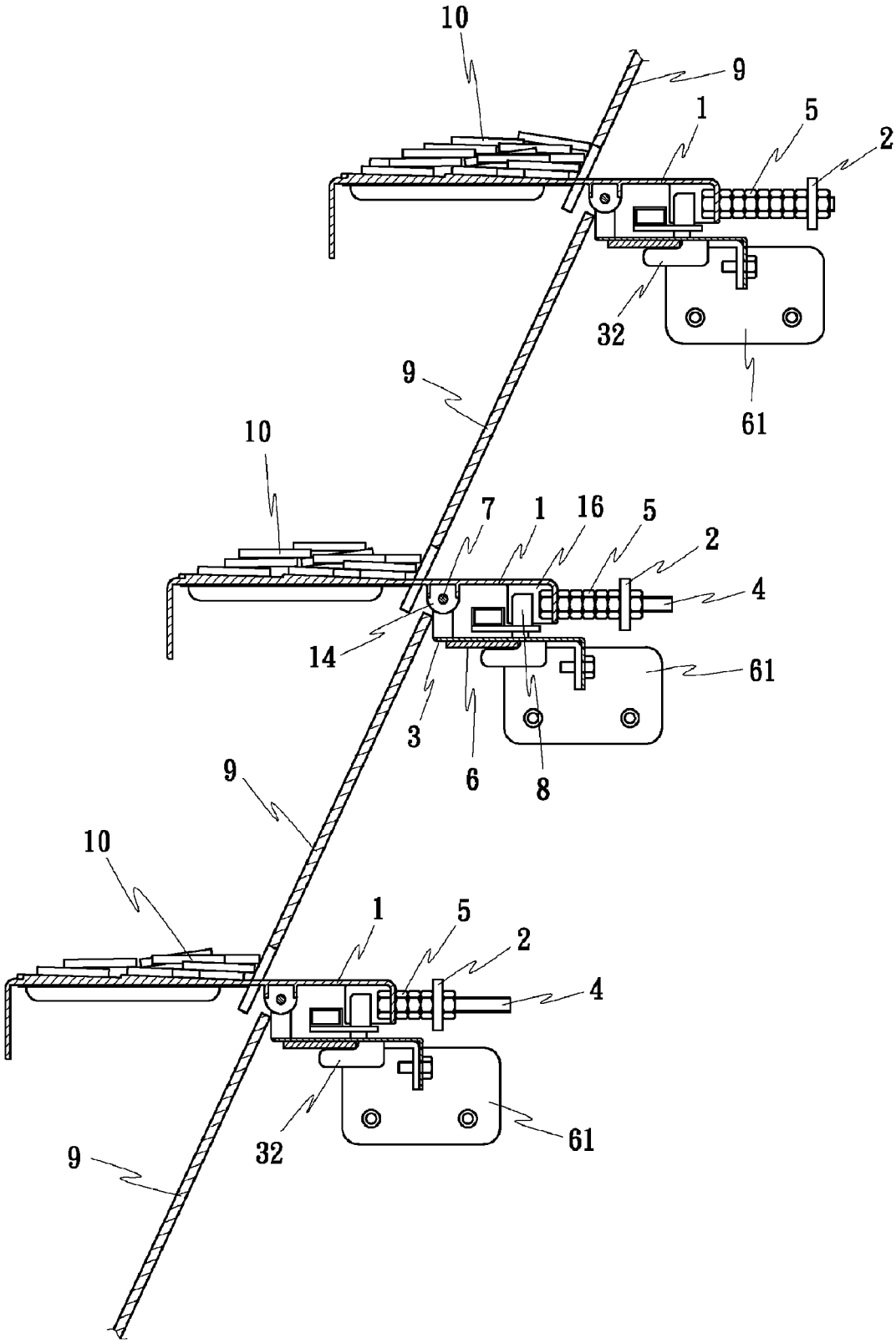
FIG. 5 is a sectional view of the present invention, showing multiple weight-controlled coin-bearing board devices mounted on oblique panels at different elevations.

Further, as shown in FIG. 5, multiple support plates 6 can be mounted inside the game machine housing to support multiple bearing boards 1. Further, the bearing boards 1 can be arranged on the support plates 6 in a staggered manner.

Further, the rear flange 11 of the bearing board 1 has a lug 15 extending from one or each of the two ends thereof (see FIG. 1) for stopping against the associated mounting plate 3 to prohibit backward tilting of the bearing board 1. Therefore, the bearing board 1 can only be tilted downwardly forwards (see FIG. 6).

Further, as shown in FIGS. 1~4, the aforesaid support plate 6 has multiple, for example, a number of pairs of slots 62 arranged along the length thereof and respectively extending in a direction perpendicular to the length; each mounting plate 3 comprises at least one, for example, two bottom plug portions 32 formed of a part thereof by means of a stamping technique for press-fitting into one pair of slots 62 on the support plate 6.

Further, as shown in FIGS. 1~4, the bottom lugs 14 of the bearing board 1 are pivotally connected to the upright flange 31 of a mounting plate 3 with a pivot pin 7 so that the bearing board 1 can be balanced on the upright flange 31 of the mounting plate 3 by the counterweight 3 and moved up and down relative to the mounting plate 3.

Referring to FIG. 4 again, a photo sensor 8 is mounted in between the bearing board 1 and the mounting plate 3 and adapted for counting the number of times that the bearing board 1 has been turned over. This value can be used for reference as the game machine provider considers changing the total weight at the side around the counterweight 2 by means of increasing or decreasing the number of nuts 5. The photo sensor 8 comprises a circuit board 83 affixed to the mounting plate 3, light transmitting/receiving elements 82, and a notched upright support 81 disposed at the top side of the circuit board 83 between the light transmitting/receiving elements 82. The bearing board 1 has a bottom shield plate 16 inserted into the notched upright support 81. Each time the bearing board 1 is tilted, the bottom shield plate 16 is moved away from the notched upright support 81, causing the photo sensor 8 to generate a signal. Because the photo sensor 8 is of the known art, no further detailed description in this regard is necessary.

Referring to FIGS. 7~10, multiple support plates 6 are horizontally affixed to oblique panels 9 at different elevations inside the game machine housing, each carrying one or multiple weight-controlled coin-bearing board devices. During application, the player operates the coin-throwing game machine to throw coins (or tokens) 10 onto the bearing boards 1 of the weight-controlled coin-bearing board devices (see FIG. 10). When one bearing board 1 collects a predetermined number of coins (or tokens) 10, this bearing board 1 will be forced by the weight of the accumulated coins (or tokens) 10 to turn downwardly forwards, causing the accumulated coins (or tokens) 10 to fall from the respective bearing board 1. This game playing method is inventive and totally different from the conventional coin-pushing game, giving players an enhanced challenge and entertainment effects.

Although particular embodiments of the invention have been described in detail for purposes of illustration, various modifications and enhancements may be made without departing from the spirit and scope of the invention, for example, hang-on type weight-mounting arrangement may be employed to substitute the mounting arrangement of the screw bolts and nuts. Accordingly, the invention is not to be limited except as by the appended claims.

What is claimed is:

1. A weight-controlled coin-bearing board device used in a game machine, comprising:

a mounting plate mounted inside said game machine;

a bearing board, said bearing board comprising at least one mounting through hole located on a rear part thereof, and at least one bottom lug on a bottom side of a middle part thereof and pivotally connected to said mounting plate;

a counterweight mounted on the rear part of said bearing board to keep said bearing board in balance on said mounting plate, said counterweight comprising at least one mounting through hole; and at least one screw bolt fastened to the at least one mounting through hole of said bearing board and the at least one mounting through hole of said counterweight to lock said counterweight to said bearing board.

2. The weight-controlled coin-bearing board device as claimed in claim 1, wherein said bearing board is a flat board member having at least one top surface portion located on a top side of a front part thereof and sloping downwardly backwards in a direction from the front part of said bearing board toward the rear part.

3. The weight-controlled coin-bearing board device as claimed in claim 1, wherein said bearing board comprises a plurality of top surface portions that rise one behind the other, each said top surface portion having a wave-like front edge.

4. The weight-controlled coin-bearing board device as claimed in claim 1, further comprising a plurality of nuts selectively mountable on said at least one screw bolt.

5. The weight-controlled coin-bearing board device as claimed in claim 1, wherein said mounting plate is mounted on a support plate inside said game machine to support said bearing board in a direction perpendicular to the extending direction of said support plate.

6. The weight-controlled coin-bearing board device as claimed in claim 1, wherein said bearing board comprises at least one lug extending from at least one of two opposite ends of the rear part thereof for stopping against said mounting plate to limit the tilting direction of said bearing board relative to said mounting plate.

7. The weight-controlled coin-bearing board device as claimed in claim 5, wherein said mounting plate comprises a plurality of bottom plug portions respectively press-fitted into respective slots on said support plate.

8. The weight-controlled coin-bearing board device as claimed in claim 1, wherein said mounting plate comprises an upright flange; said at least one bottom lug of said bearing board is pivotally connected to the upright flange of said mounting plate with a pivot pin.

9. The weight-controlled coin-bearing board device as claimed in claim 1, further comprising a photo sensor mounted in between said bearing board and said mounting plate adjacent to a bottom shield plate of said bearing board and adapted for counting the number of times that said bearing board is tilted.

* * * * *